US009299212B2

(12) United States Patent
Amano et al.

(10) Patent No.: US 9,299,212 B2
(45) Date of Patent: Mar. 29, 2016

(54) METHOD AND APPARATUS FOR COUNTING AND DISPENSING MEDICATION

(75) Inventors: Hirokazu Amano, Toyonaka (JP); Norifumi Oike, Toyonaka (JP); Yasuyuki Morita, Toyonaka (JP)

(73) Assignee: YUYAMA MANUFACTURING CO., LTD., Toyonaka-Shi, Osaka (JP)

( * ) Notice: Subject to any disclaimer, the term of this patent is extended or adjusted under 35 U.S.C. 154(b) by 943 days.

(21) Appl. No.: 13/505,497

(22) PCT Filed: Nov. 10, 2010

(86) PCT No.: PCT/JP2010/070001

§ 371 (c)(1), (2), (4) Date: May 2, 2012

(87) PCT Pub. No.: WO2011/062101

PCT Pub. Date: May 26, 2011

(65) Prior Publication Data

US 2012/0216485 A1 Aug. 30, 2012

(30) Foreign Application Priority Data

Nov. 17, 2009 (JP) ..... 2009-261660

(51) Int. Cl.
*B65B 57/20* (2006.01)
*G07F 17/00* (2006.01)
(Continued)

(52) U.S. Cl.
CPC ..... *G07F 17/0092* (2013.01); *A61J 7/02* (2013.01); *B65B 57/20* (2013.01); *G07F 11/44* (2013.01); *B65B 5/103* (2013.01)

(58) Field of Classification Search
CPC ..... G07F 17/0092; G07F 11/44; G06T 7/60; B65B 5/103; B65B 5/101; B65B 57/20; B65B 65/08; A61J 7/02; G06K 9/3241
USPC ..... 53/500, 64, 493, 498, 501, 503, 450, 53/451, 455, 459, 550–555.562, 568, 167; 382/192, 128, 110, 165, 190, 195
See application file for complete search history.

(56) References Cited

U.S. PATENT DOCUMENTS 5,463,839 A 11/1995 Stange et al.
5,638,657 A * 6/1997 Archer et al. ..... 53/253
(Continued)

FOREIGN PATENT DOCUMENTS

JP 7200770 A 8/1995
JP 8322912 A 12/1996
(Continued)

OTHER PUBLICATIONS

International Search Report for PCT/JP2010/070001, dated Feb. 15, 2011.

*Primary Examiner* — Stephen F Gerrity
(74) *Attorney, Agent, or Firm* — Hauptman Ham, LLP

(57) ABSTRACT

A medication dispensing device has: a medication preparation unit provided with a storage section that can store and discharge one package at a time of a solid medication supplied by a medication supply unit; and a counting unit that can count the solid medication discharged from the storage section. The counting unit is provided with: a monitoring platform on which the solid medication discharged from the storage section rests; an vibration unit that can vibrate the monitoring platform horizontally; an imaging unit that can image the solid medication on the monitoring platform that has been vibrated; and an image recognition unit that can count the solid medication on the basis of the image obtained by the imaging unit.

10 Claims, 11 Drawing Sheets

(51) Int. Cl.

| | |
|---|---|
| ***G07F 11/44*** | (2006.01) |
| ***A61J 7/02*** | (2006.01) |
| *B65B 5/10* | (2006.01) |

(56) References Cited

U.S. PATENT DOCUMENTS

| | | | | |
|---|---|---|---|---|
| 6,324,253 | B1 * | 11/2001 | Yuyama et al. | 378/57 |
| 7,582,872 | B2 * | 9/2009 | Lewis et al. | 250/339.06 |
| 2001/0041968 | A1 * | 11/2001 | Hamilton | 702/128 |
| 2006/0045323 | A1 * | 3/2006 | Ateya | 382/141 |
| 2006/0058724 | A1 * | 3/2006 | Handfield et al. | 604/20 |
| 2006/0213816 | A1 * | 9/2006 | Jorritsma | 209/576 |
| 2008/0307757 | A1 * | 12/2008 | Heim et al. | 53/500 |
| 2009/0123056 | A1 * | 5/2009 | Vanegas et al. | 382/141 |
| 2010/0045976 | A1 * | 2/2010 | Jorritsma | 356/240.1 |
| 2010/0076595 | A1 * | 3/2010 | Nguyen | 700/232 |
| 2010/0175352 | A1 * | 7/2010 | Soloman | 53/508 |
| 2010/0175968 | A1 * | 7/2010 | Yagyu et al. | 198/761 |

FOREIGN PATENT DOCUMENTS

| | | | |
|---|---|---|---|
| JP | 11309198 | A | 11/1999 |
| JP | 2000276583 | A | 10/2000 |
| JP | 2005289507 | A | 10/2005 |
| WO | 2008155950 | A1 | 12/2008 |

* cited by examiner (a)

(d)

(b)

(e)

(c)

(f)

(a)

(b)

(c)

(a)

(b)

(c)

METHOD AND APPARATUS FOR COUNTING AND DISPENSING MEDICATION

RELATED APPLICATIONS

The present application is a National Phase of International Application Number PCT/JP2010/070001, filed Nov. 10, 2010, and claims priority from Japanese Application Number 2009-261660, filed Nov. 17, 2009.

BACKGROUND OF THE INVENTION

1. Technical Field

The present invention relates to a medication dispensing device that can dispense and individually wrap solid medications to be suitable for a prescription, and more particularly to a medication dispensing device that can monitor the quantity of solid medications prepared for dispensing.

2. Background Art

A medication dispensing device as disclosed in patent document below was proposed in the prior art. The medication dispensing device as disclosed in the patent document below is adapted to be capable of individually wrapping and supplying granulated or capsulated solid medications one package dose at a time with an individual wrapping paper. In addition, the medication dispensing device related to the patent document below is configured to be capable of imaging solid medications in a state in which the solid medications are wrapped with an individual wrapping paper, and monitoring the quantity of the solid medications based on an image obtained thereby.

PRIOR ART DOCUMENT

Patent Document

Japanese Patent Laid-open Publication H7-200770

DISCLOSURE OF INVENTION

Technical Problem

As described above, in the medication dispensing device related to the patent document, solid medications are imaged in the state in which they are separately wrapped with an individual wrapping paper. As a result, plural solid medications are apt to be imaged in a state that they overlap and in contact with each other in the individual wrapping paper. Due to this, with the prior art technology, there is a problem in that unless an image processing is conducted by an image recognition means, plural solid medications may be erroneously recognized as a single mass, which may highly possibly result in incorrect determination of the quantity of the solid medications. Furthermore, in the prior art, counting is based on the image of the solid medications imaged outside the individual wrapping paper, which causes the individual wrapping paper to be interposed and causes characters or the like printed on the individual wrapping paper to be reflected in the image, so that the precision of the image may be deteriorated to such an extent that precision in counting may also be deteriorated.

Therefore, the object of the present invention is to provide a medication dispensing device that can properly monitor the quantity of solid medications without making a counting mistake due to overlap or contact among the solid medications or the existence of an individual wrapping paper.

Technical Solution

A medication dispensing device in accordance with the present invention has been made to solve the above-mentioned problems, and includes: a medication supply means that can supply medications to be suitable for a prescription; a medication preparation means having a storage section that can store and discharge the solid medications supplied from the medication supply means one package dose at a time; and a counting means that can count the quantity of the solid medications discharged from the storage section. In the inventive medication dispensing device, the counting means includes: a medication monitoring platform on which the solid medications discharged from the storage section is laid; an vibration means that can vibrate the medication monitoring platform horizontally; an imaging means that can image the solid medications on the medication monitoring platform that has been vibrated; and an image recognizing and processing means that can count the number of the solid medications on the basis of an image obtained by the imaging means. In addition, the inventive medication dispensing device is preferably configured to perform quantity monitoring by comparing the quantity of the solid medications counted by the image recognizing and processing means with the quantity of the solid medications based on prescription data and to be dispensed as one package dose from a tablet separate-wrapping device.

The inventive medication dispensing device preferably employs an vibration means that can reciprocate the medication monitoring platform horizontally to vibrate the medication monitoring platform, as the vibration means. In addition, the inventive medication dispensing device may be configured in such a manner that the imaging means can image the solid medications discharged as one package dose to the medication monitoring platform a plural number of times while the medication monitoring platform is vibrating. In such a case, the inventive medication dispensing device may be configured to count the quantity of solid medications by the image recognizing and processing means for each of the plural images obtained by imaging the solid medications related to the same prescription, and the largest one among the quantities of the solid medications obtained as a result of counting is recognized as the quantity of the solid medications related to a corresponding prescription.

The inventive medication dispensing device preferably includes: a plurality of grooves which are formed on the bottom of the medication monitoring platform by protrusions and/or recesses extending in a direction following the vibration direction of the medication monitoring platform and are arranged in a direction crossing the vibration direction. In addition, the inventive medication dispensing device may be configured in such a manner that the medication monitoring platform is installed at a position adjacent to an inner or outer periphery of the medication preparation means, and that the medication preparation means is provided with a plurality of storage sections installed side by side in the circumferential direction thereof, and is configured to move each of the storage sections to a position facing the medication monitoring platform so that the solid medication can be discharged from each of the storage sections to the medication monitoring platform.

Advantageous Effects

Since the medication dispensing device is configured to directly image solid medications discharged from the storage sections of the medication preparation means to the medication monitoring platform rather than imaging the solid medication outside an individual wrapping paper as in the prior art, there is not caused deterioration in an image or in precision of counting due to the interposition of the individual wrapping paper or characters printed on the individual wrapping paper reflected in the image.

In the medication dispensing device, because the solid medications are compressed when they are discharged from the medication preparation means, and spread on the medication monitoring platform, it is more difficult for the medications to overlap or in contact with each other as compared to the case in which the medications are imaged in the wrapped state. In addition, the medication dispensing device is configured to be capable of vibrating the medication monitoring platform horizontally by the vibration means. Therefore, it interacts with difference in rolling easiness or rolling method due to a difference in shape or center of gravity between individual solid medications, so that the individual solid medications are scattered and rolled to be widely spread on the medication monitoring platform. In the inventive medication dispensing device, since the solid medications are imaged by the imaging means in the state in which the medication monitoring platform is vibrated, overlap or contact among the solid medications cannot occur in an image obtained for counting. Therefore, the inventive medication dispensing device makes it possible to count the number of the solid medications correctly on the basis of the image obtained by the imaging means.

In addition, in the inventive medication dispensing device, it is possible to monitor the quantity of solid medications by comparing the quantity of solid medications counted by the image recognizing and processing means and the quantity of solid medications based on prescription data and to be dispensed as one package dose from the tablet separate-wrapping means.

In the inventive medication dispensing device, when an vibration means configured to reciprocate the medication monitoring platform horizontally is employed, solid medications are facilitated to be smoothly spread on the medication monitoring platform under the influence of a difference in shape and center of gravity between the individual solid medications, a difference in inertia applied to the solid medications and the like. Therefore, it is possible to prevent the occurrence of a counting mistake due to overlap among the solid medications by configuring the medication monitoring platform to be reciprocated horizontally by the vibrating means.

Here, it is believed that when the medication monitoring platform is vibrated as described above, solid medications overlapping or in contact with each other are gradually moved away from each other under the influence of the vibration, so that the solid medications are positioned in a state in which they can be counted as individually separated ones. Therefore, as in the inventive medication dispensing device, if the imaging means is adapted to image solid medications dispensed as one package dose to the medication monitoring platform a plural number of times while the medication monitoring platform is being vibrated, and the largest one among the quantities of the solid medications counted by the image recognizing and processing means on the basis of the plural images obtained thereby is adapted to be recognized as the quantity of the solid medications related to a corresponding prescription, it is possible to more reliably prevent the occurrence of a counting mistake.

In addition, as in the inventive medication dispensing device, if a plurality of grooves formed on the bottom of the medication monitoring platform by protrusions and/or recesses extending in a direction following the vibration direction of the medication monitoring platform are arranged in a direction crossing the vibration direction, solid medications can be guided by the grooves to be smoothly spread on the medication monitoring platform. Therefore, if grooves formed by protrusions or recesses as described above are provided, it is possible to more reliably prevent a counting mistake of solid medications. In addition, the width of each of the above-mentioned grooves in the present invention (the length in a groove in the direction crossing the vibration direction) can be properly set so that an interval suitable for guiding the solid medications can be provided, and can be set with reference to, for example, a size of an ordinary solid medication used in prescription.

The inventive medication dispensing device employs a plurality of storage sections arranged side by side in the circumferential direction as the medication preparation means, and provides the medication monitoring platform at a position adjacent to the outer or inner periphery of the medication preparation means. In addition, the inventive medication dispensing device is configured to move each of the storage sections to a position facing the medication monitoring platform, so that the solid medications can be discharged from each of the storage sections to the medication monitoring platform. Therefore, in the inventive dispensing device, it is needless to provide the medication monitoring platform at each of the storage sections, which makes it possible to provide a compact construction even though the medication monitoring platform is provided.

BRIEF DESCRIPTION OF THE DRAWINGS

FIG. 9 shows images obtained at individual processes when solid medications are counted by the medication counting means, in which FIG. 9*a* shows a concentration-corrected image, FIG. 9*b* shows a mask-processed image, FIG. 9*c* is a background-removed image, FIG. 9*d* is a simple binary image, FIG. 9*e* is a binary difference image, and FIG. 9*f* shows a binary composite image;

FIG. 10 shows images obtained at individual processes when the solid medications are counted by the medication counting means, in which FIG. 10*a* shows a reverse image, FIG. 10*b* shows a contraction image, and FIG. 10*c* shows a contour image.

BEST MODE FOR INVENTION

Figure 1:
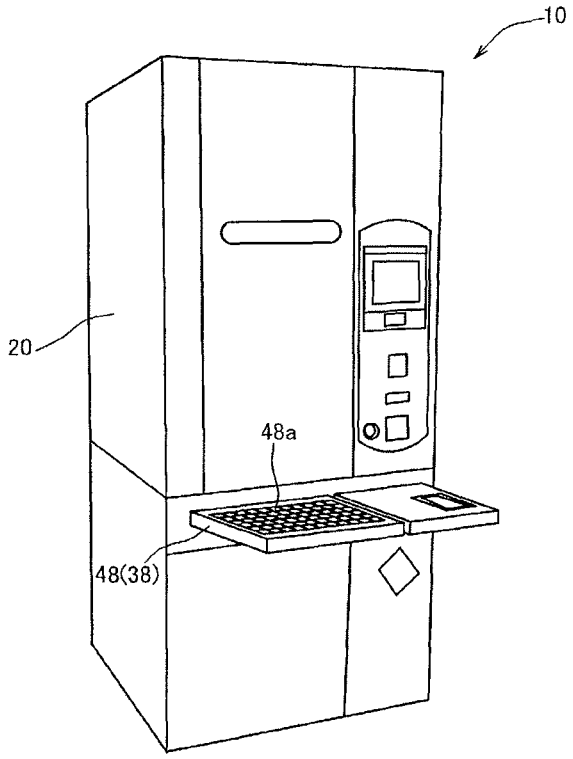
FIG. 1 is a perspective view showing an external appearance of a medication dispensing device in accordance with an embodiment of the present invention.
Figure 2:
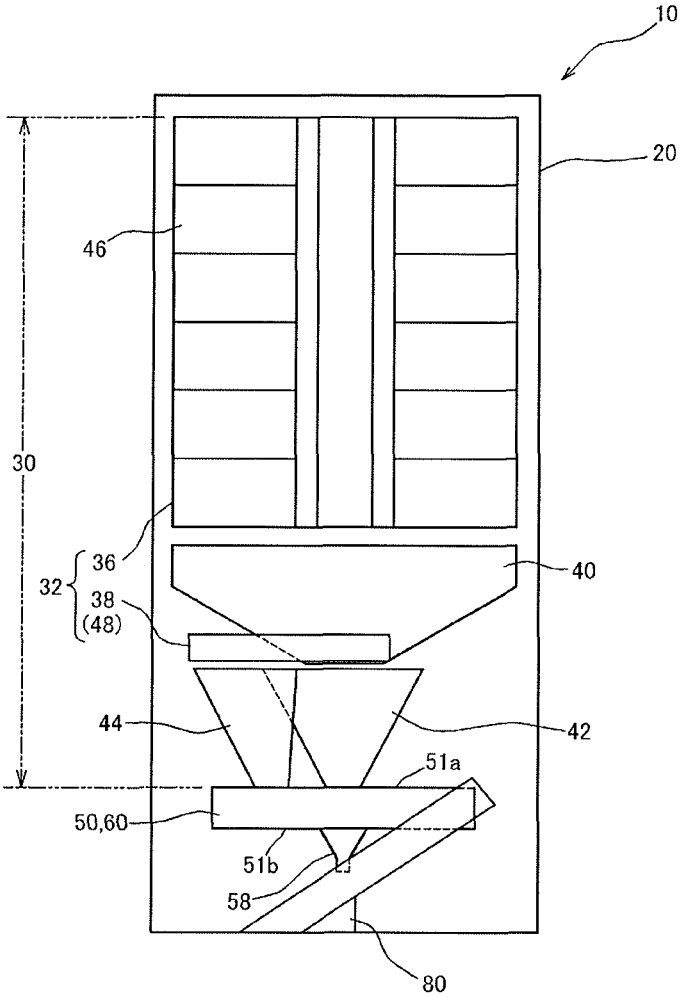
FIG. 2 is an illustrative view schematically showing the internal construction of the medication dispensing device of FIG. 1.

Hereinafter, a medication dispensing device 10 in accordance with an embodiment of the present invention will be described with reference to the accompanying drawings. The medication dispensing device 10 dispenses solid medications by wrapping the solid medications with an individual wrapping paper for each prescription. As shown in FIG. 1, the medication dispensing device 10 has a rectangular parallelepiped main body 20. As shown in FIG. 2, the medication dispensing device 10 includes a medication supply means 30, a medication preparation means 50, a medication counting means 60, and a medication wrapping means 80 within the main body 20.

The medication supply means 30 is provided to store solid medications, and to properly discharge and supply the solid medications to the medication wrapping means 80 in accordance with a prescription. The medication supply means 30 includes a supply unit 32. The supply unit 32 functions to store and discharge the solid medications toward the medication preparation means 50 in accordance with a prescription. In addition, the medication preparation means 50 functions to collect the solid medications supplied from the supply unit 32 one package dose at a time, and to sequentially discharge the solid medications toward the medication wrapping means 80.

Specifically, as shown in FIG. 2, the supply unit 32 includes a feeder type supply unit 36 and a manual spreader type supply unit 38 as a means for supplying the solid medications. In addition to these, the supply unit 32 includes a standby hopper 40, a collection hopper 42, and a manual spreading hopper 44. The feeder type supply unit 36 includes a plurality of cassette type medication feeders 46, so that the solid medications, which have been classified and prepared in advance in each of the medication feeders 46, can be discharged in accordance with a prescription. The standby hopper 40 is located below the feeder type supply unit 36. The standby hopper 40 may collect solid medications dispensed from each of the medication feeders 46 one package dose at a time, and then may discharge the solid medications at once. The solid medications discharged from the standby hopper 40 are supplied to the medication preparation means 50 one package dose at a time through the collection hopper 42 provided below the standby hopper 40.

In addition, the spreader type supply unit 38 is prepared separately from the feeder type supply unit 36, in which like the feeder type supply unit 36, the spreader type supply unit 38 can supply the solid medications toward the medication preparation means 50. The manual spreader type supply unit 38 includes a manual spreading unit 48. The manual spreading unit 48 is always housed in the main body 20. However, as shown in FIG. 1, the manual spreading unit 48 is adapted to be capable of being removed from the front side of the main body 20 to be used as desired. As shown in FIG. 1, the manual spreading unit 48 is formed by installing a plurality of reception compartments (cells) 48*a* in a matrix form, each of which can receive solid medications one package dose at a time. The manual spreading unit 48 can supply the solid medications to the medication preparation means 50 one package dose at a time by opening the reception compartments 48*a* one by one. The manual spreading unit 48 is in a state in which the solid medications can be refilled in each of the reception compartments 48*a* when it is removed as shown in FIG. 1. In addition, when the manual spreading unit 48 is received in the main body of the medication dispensing device 10, the manual spreading hopper 44 is positioned below the manual spreading unit 48, and the solid medications prepared in each of the reception compartments 48*a* can be supplied to the medication preparation means 50 through the manual spreading hopper 44 installed below the manual spreading unit 48.

Figure 3:
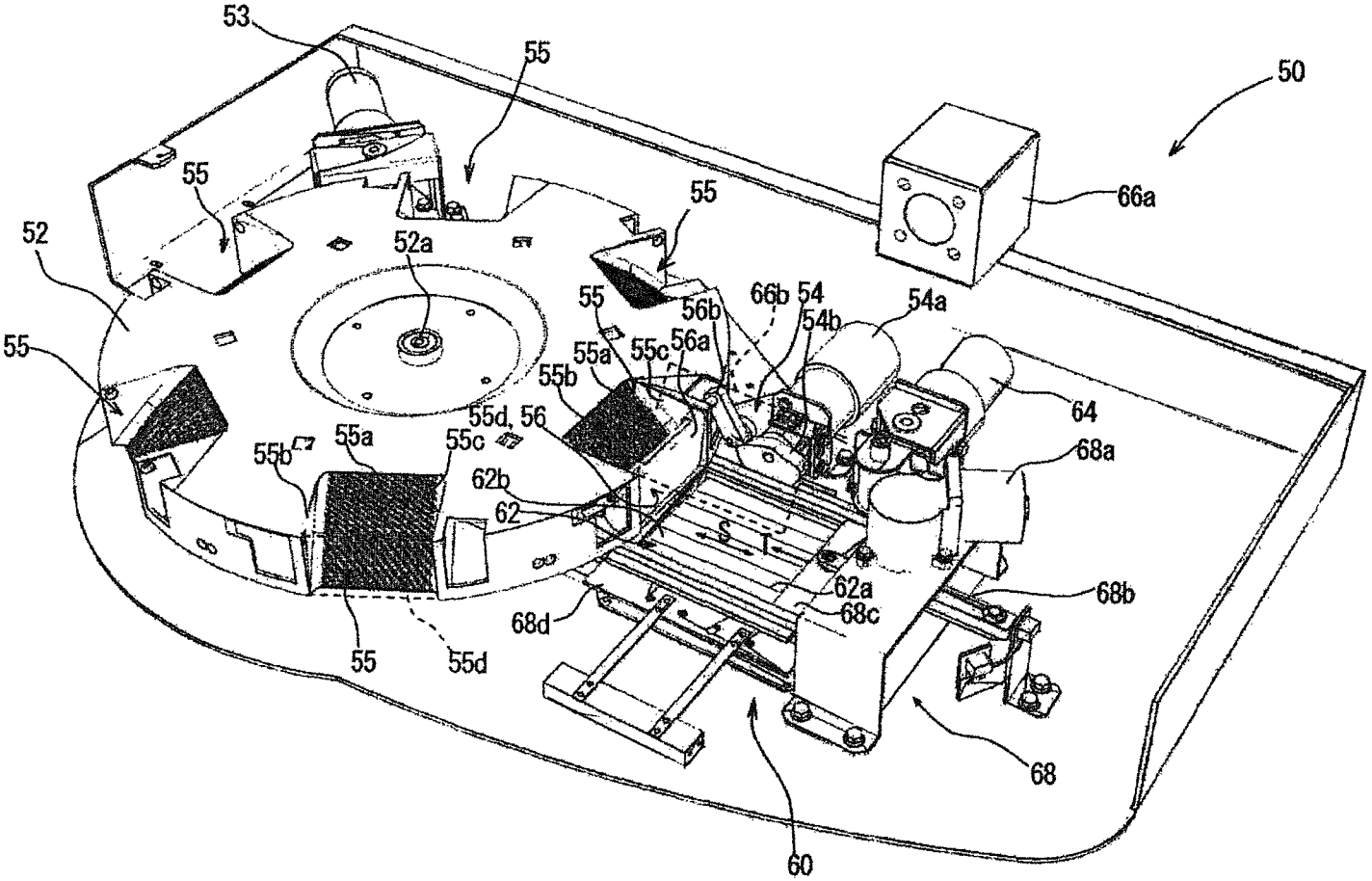
FIG. 3 is a perspective view showing the constructions of a medication preparation means and a medication counting means.
Figure 6:
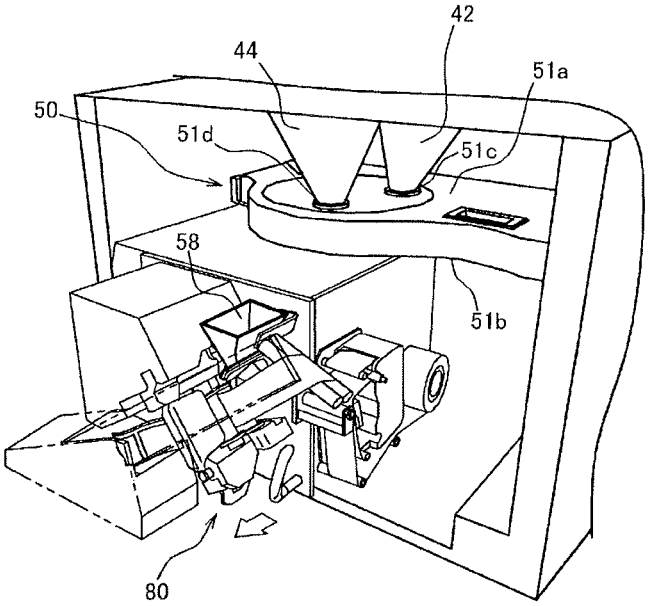
FIG. 6 is a perspective view showing a medication preparation means and a medication wrapping means.

As shown in FIG. 2, the medication preparation means 50 is arranged below the above-mentioned supply unit 32. The medication preparation means 50 can store the solid medications received from the medication supply means 30 through the above-mentioned collection hopper 42 or the manual spreading hopper 44 one package dose at a time, and can supply the solid medications toward the medication wrapping means 80. Specifically, as shown in FIG. 3, the medication preparation means 50 has a principal part configured by a section forming body 52, and also includes a driving source 53, a driving mechanism (not shown), a shutter opening/closing mechanism 54 and the like. The section forming body 52, the driving source 53 and the like of the medication preparation means 50 are received within a space between horizontally arranged top and bottom plates 51*a* and 51*b* (see FIG. 6). As shown in FIG. 6, inlet ports 51*c* and 51*d* are formed in the top plate 51*a*. An outlet port (not shown) is formed in the bottom plate 51*b*. The collection hopper 42 and the manual spreading hopper 44 of the medication supply means 30 as described above are connected to the inlet ports 51*c* and 51*d*, respectively. In addition, a supply hopper 58 is provided below the outlet port formed in the bottom plate 51*b*, so that the solid medications discharged from the outlet port can be supplied to the medication wrapping means 80.

As shown in FIG. 3, the section forming body 52 has a substantially disk-shaped appearance, and is formed with plural (in the example of FIG. 3, six) storage sections 55 at predetermined intervals along the circumference thereof. The section forming body 52 is adapted to be rotatable about the central axis 52*a* thereof by receiving power from a driving source 53 through a driving mechanism (not shown). The storage section 55 is adapted to feed solid medications, which are supplied from the medication supply means 30, through the inlet ports 51*c* and 51*d* formed in the top plate 51*a*. In addition, the section forming body 52 is horizontally installed at a position spaced slightly above the bottom plate 51*b*. The size of the gap formed between the section forming body 52 and the bottom plate 51*b* is determined to allow a dispensing means 68 of the medication counting means 60 to move back and forth. The dispensing means 65 of the medication counting means 60 will be described in detail below.

Figure 4:
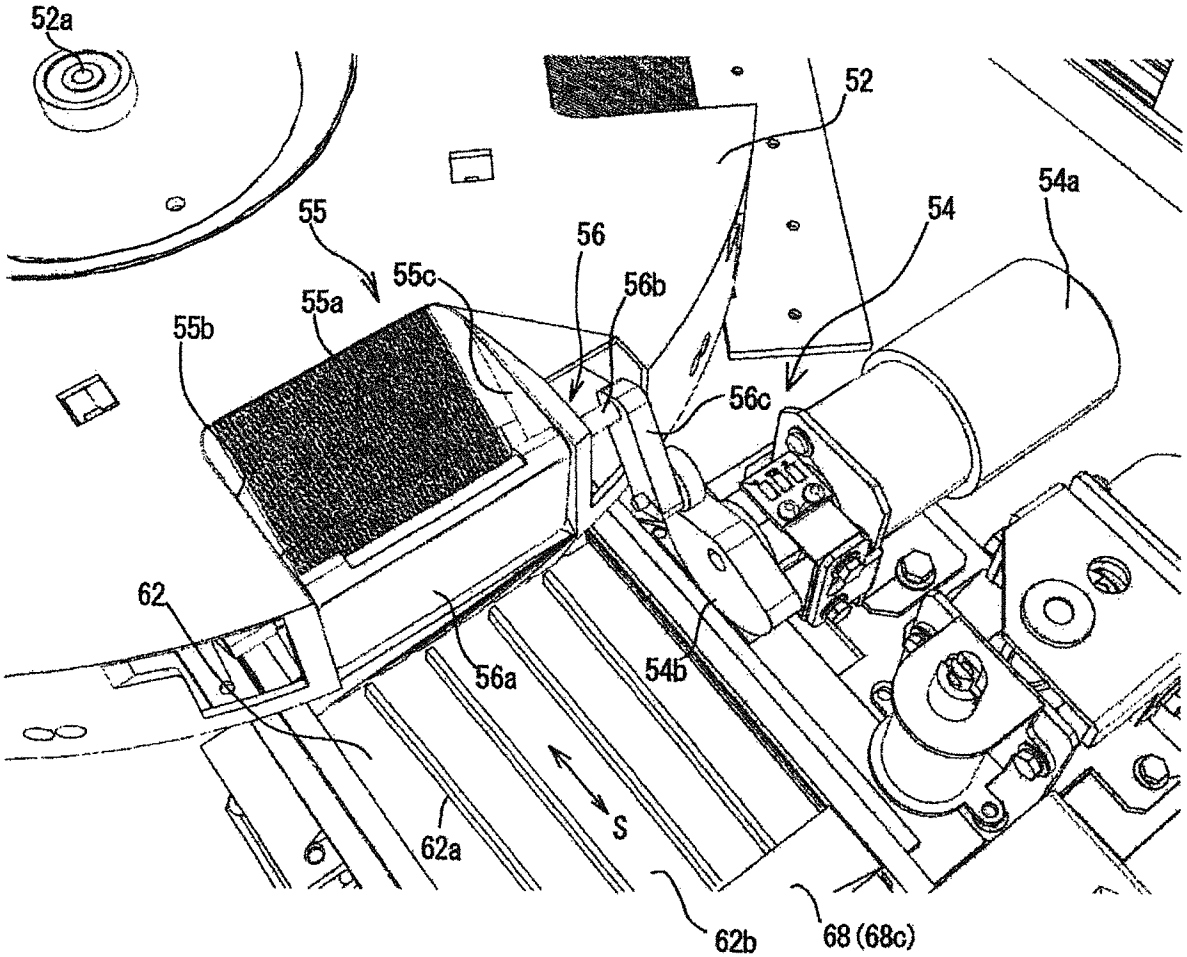
FIG. 4 is a perspective view showing a main part of FIG. 3 in an enlarged scale.

As shown in FIGS. 3 and 4, each of the storage sections 55 is configured by a region surrounded on three sides by a bottom surface 55*a* inclined downward as extending from the center to the outside of the section forming body 52, and side surfaces 55*b* and 55*c*, in which a part corresponding to an opening 55*d* on the outer peripheral of the section forming body 52 is closed by a shutter 56. Although FIG. 3 does not show shutters 56 for other storage sections 55 except for the storage section 55 adjacent to an image recognizing and processing means 70 in FIG. 3, the other storage sections 55 except the storage section 55 adjacent to the medication counting means 60 are also provided with the shutters 56, respectively.

The shutter 56 is formed by fastening a shutter plate 56*a* to a support shaft 56*b* extending between the side surfaces 55*b* and 55*c* to be capable of being opened/closed. The shutter plate 56*a* is normally pressed in such a manner that the shutter 56 is flush with the outer periphery of the section forming body 52. As a result, the opening 55*d* is closed by the shutter plate 56*a*, so that solid medications can be prevented from being discharged from the storage section 55. In addition, the shutter plate 56*a* can be rotated about the support shaft 56*b* by pushing and rotating a lever 56*c* attached to a tip end of the support shaft 56*b* to open the opening 55*d* so as to allow the solid medications to be in a dischargeable state.

A shutter opening/closing mechanism 54 is provided so as to allow the shutter plate 56*a* to be in the opened state by pushing and rotating the lever 56*c* provided for manipulating the shutter 56. As shown in FIG. 4, the shutter opening/closing mechanism 54 includes a motor 54*a* having a rotation axle installed to protrude substantially horizontally, and a cam 54*b* attached to the rotation axle. The shutter opening/closing mechanism 54 is installed adjacent to a monitoring platform 62 or an vibration means 64, etc of the medication counting means 60, which will be described in detail below. When the shutter 56 (a storage section 55) arrives at a position facing the monitoring platform 62, the shutter opening/closing mechanism 54 operates the motor 54*a* to allow the cam 54*b* to come into contact with the lever 56*c* of the shutter 56 and to push and rotate the lever 56*c* of the shutter 56. Therefore, the individual storage sections 55 can be sequentially moved to the position facing the monitoring platform 62 by rotating the section forming body 52 about the central axis 52*a*, and at the same time, the shutter opening/closing mechanism 54 is operated to open the shutter plate 56*a*, so that the solid medications received in the individual storage sections 55 can be discharged toward the monitoring platform 62.

Figure 7:
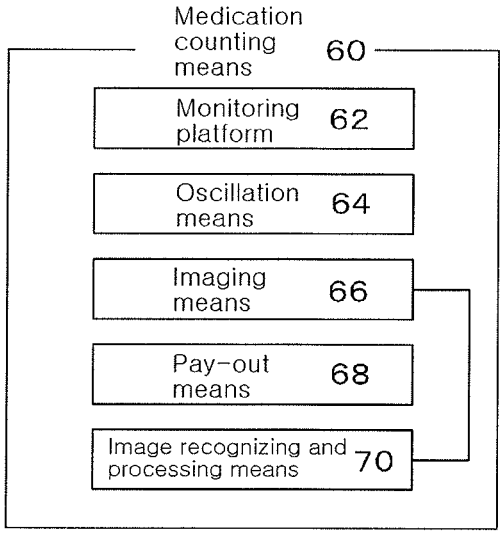
FIG. 7 is a block diagram showing a construction of a medication counting means.

The medication counting means 60 is provided to count and monitor the quantity of the solid medications prepared one package dose at a time in each of the storage sections 55 in the medication preparation means 50. As shown in FIGS. 3 and 4, the medication counting means 60 includes a monitoring platform 62, an vibration means 64, an imaging means 66, and a dispensing means 68. As shown in FIG. 7, the medication counting means 60 further includes an image recognizing and processing means 70 in addition to the above-mentioned components. The monitoring platform 62 is provided at a position adjacent to the outer periphery of the section forming body 52 of the medication preparation means 50. The monitoring platform 62 is a table on which solid medications are discharged from each of the storage sections 55 of the section forming body 52, and is configured by a light-transmitting panel.

As indicated by arrow S in FIGS. 3 and 4, the monitoring platform 62 can make the solid medications vibration as it reciprocates toward and away from the section forming body 52 in accordance with the operation of the vibration means 64. Protrusions 62*a*, each of which extends in a string shape, are formed at predetermined intervals on the monitoring platform 62 in a direction intersecting (crossing substantially at right angles) the vibration direction of the monitoring platform 62. As a result, a recess 62*b* extending in the vibration direction of the monitoring platform 62 is formed between each two adjacent protrusions 62*a* and 62*a*. In addition, the width of the recess 62*b*, i.e. the interval between adjacent protrusions 62*a* is determined to allow a solid medication with an ordinary size used in the medication dispensing device 10 to be introduced between the protrusions 62*a* and 62*a*.

Figure 5:
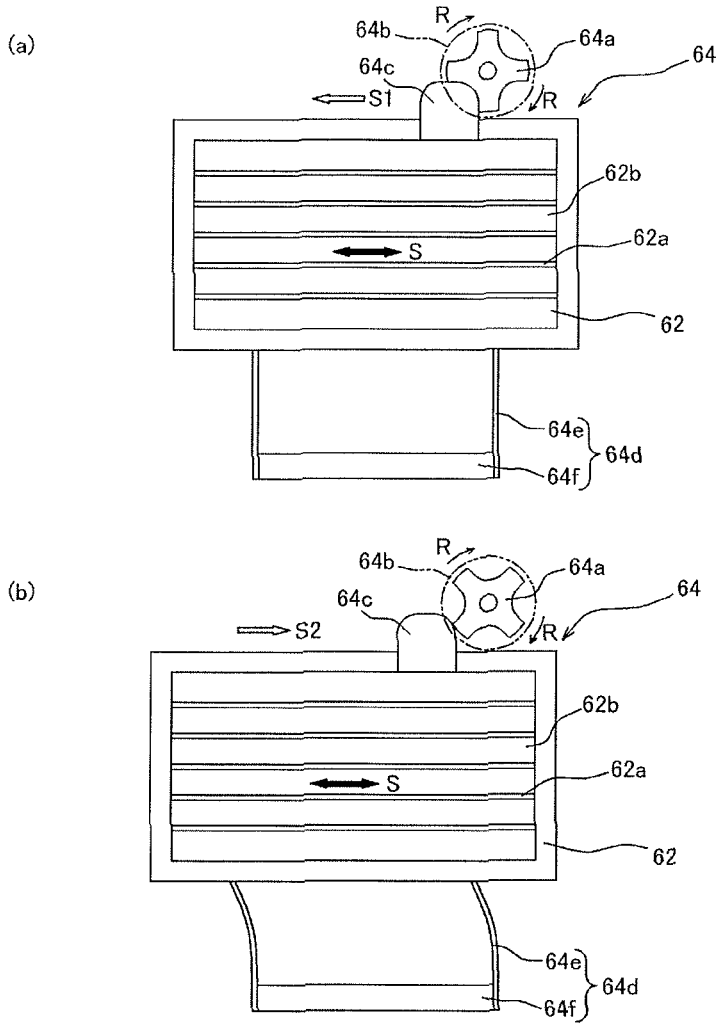
FIGS. 5*a* and 5*b* are illustrative views schematically showing the operating state of a vibration means.

As shown in FIG. 5, the vibration means 64 includes a cam 64*a* (not shown in FIGS. 3 and 4), a motor 64*b*, an abutment member 64*c*, and a compression member 64*d*. The cam 64*a* is formed as a plate cam with a concavo-convex outer periphery, and adapted to be capable of being rotated by receiving power from the motor 64*b* installed at a side (at the inner side in FIG. 3) of the monitoring platform 62. The abutment member 64*c* is positioned on a side wall of the monitoring platform 62, and fixed to protrude from the monitoring platform 62 toward a side of the cam 64*a*. In addition, the compression member 64*d* has a leaf spring 64*e* and an anchoring part 64*f*, and is installed opposite (at the front side in FIG. 3) to the cam 64*a* and the motor 64*b* across the monitoring platform 62. The leaf spring 64*e* has a base end anchored to the anchoring part 64*f*, and a tip end anchored to the side wall of the monitoring platform 62. The leaf spring 64*e* is adapted to be bent when the monitoring platform 62 is moved toward the section forming body 52 (in the direction indicated by arrow S1 in FIG. 5), and in the opposite direction (in the direction indicated by arrow S2 in FIG. 5), the leaf spring 64*e* is adapted to compress and push the monitoring platform 62 to return the monitoring platform 62 to its original position. In order for the leaf spring 64*e* to exhibit the bending and compressing functions more efficiently, glass fiber is preferably used as the material of the leaf spring 64*e*.

When the motor 64*b* is operated, the cam 64*a* is rotated in the direction indicated by arrow R in FIG. 5 (in the clockwise direction). As a result, the surrounding surface of the abutment member 64*c* anchored to the monitoring platform 62 and the concave parts of the cam 64*a* are intermittently engaged with each other. While any of the convex parts of the cam 64*a* are abutting against the abutment member 64*c*, the monitoring platform 62 is compressed against the compressive force applied by the leaf spring 64*e*, and moved toward the section forming body 52 (in the direction indicated by arrow S1). Meanwhile, if the cam 64*a* is further rotated, the compressive force applied to the abutment member 64*c* by the cam 64*a* is released, and the monitoring platform 62 is moved away from the section forming body 52 (in the direction indicated by arrow S2) under the influence of the compressive force of the leaf spring 64*e* to such an extent that one of the concave parts of the cam 64*a* is engaged with the abutment member 64*c*. As such, the cam 64*a* and the abutment 64*c* intermittently repeat the engagement action, which causes the monitoring platform 62 to reciprocate in the directions indicated by arrow S (directions indicated by arrows S1 and S2), so that the solid medications will be made to vibrate.

The imaging means 66 includes a camera 66*a*, a mirror 66*b* and an illumination (not shown). The camera 66*a* may be formed by a conventionally well-known CCD (Charge Coupled Device) camera or the like. The camera 66*a* is fixed at a position laterally located in relation to the monitoring platform 62 and above the monitoring platform 62. The mirror 66*b* is arranged above the monitoring platform 62 so that the entirety of the monitoring platform 62 can be reflected in the mirror 66*b*. In addition, the illumination (not shown) has a light source configured by an LED, a fluorescent lamp or the like, and is adapted to emit light toward the mirror 66*b* from the lower side of the monitoring platform 62 toward the mirror 66*b* positioned above the monitoring platform 62. Therefore, the imaging means 66 can image the entirety of the monitoring platform 62 using transmitted light illuminated through the mirror 66*b*. The camera 66*a* is electrically connected to the image recognizing and processing means 70, and is adapted to be capable of transferring image data photographed by the camera 66*a* to the image recognizing and processing means 70. The imaging means 66 is adapted to be capable of continuously imaging solid medications existing on the monitoring platform 62 multiple times in a state in which the monitoring platform 62 is vibrated.

The dispensing means 68 is provided to brush off and discharge the solid medications laid on the monitoring platform 62 to a discharge port (not shown) installed below the section forming body 52. The dispensing means 68 includes a power source 68*a*, a power transfer mechanism 68*b*, a sliding movement body 68*c*, and guide frames 68*d*. The power source 68*a* may be configured by a conventionally well-known motor or the like. In addition, the power transfer mechanism 68*b* may be configured by a conventionally well-known link mechanism or the like, and adapted to transfer power produced by the power source 68*a* to the sliding movement body 68*c* so as to linearly reciprocate the sliding movement body 68*c*.

The sliding movement body 68*c* is formed by a rectangular sheet metal having a length substantially equal to that of the monitoring platform 62. Upon receiving the power through the power transfer mechanism 68*b*, the sliding movement body 68*c* is guided by the guide frames 68*d* arranged along the opposite sides thereof in such a manner that the sliding movement body 68*c* can be reciprocated toward and away from the section forming body 52 on the monitoring platform 62. The sliding movement body 68*c* is normally positioned out of the monitoring platform 62, and prevents the solid medications from falling off the monitoring platform 62. In addition, the sliding movement body 68*c* is slid on the monitoring platform 62 as indicated by arrow T in FIG. 3 to push the solid medications existing on the monitoring platform 62 to the lower side of the section forming body 52 so that the solid medication can be discharged through the discharge port (not shown).

Figure 8:
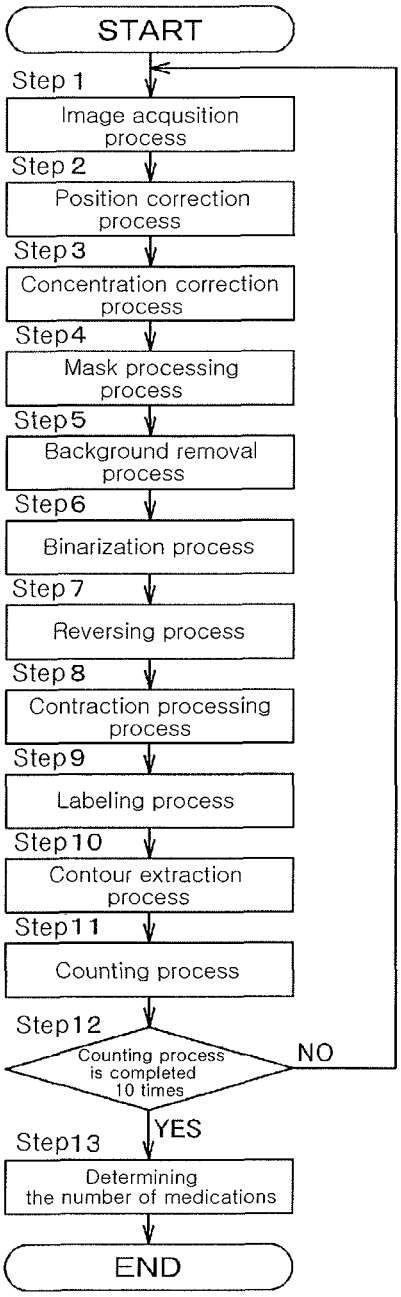
FIG. 8 is a flowchart of an operation when solid medications are counted by the medication counting means.

The image recognizing and processing means 70 can count the quantity of the solid medications by analyzing images photographed by the imaging means 66. The image recognizing and processing means 70 may be configured by a conventionally well-known personal computer or the like. As shown in the flowchart of FIG. 8, the image recognizing and processing means 70 can count the number of the solid medications reflected in the images after passing through various processes from an image acquisition process related to step 1 to a counting process related to step 11. In the present embodiment, imaging by the imaging means 66 is conducted a plural number of times (ten times in the present embodiment) while the monitoring platform 62 is being vibrated as the vibration means 64 is operated as described above. The image recognizing and processing means 70 repeats processes associated with steps 1 to 11 (hereinafter, the processes may be referred to as a "counting process") in relation to the plural images (in the present embodiment, ten images) acquired by the imaging means 66, and conducts counting of the solid medications based on each of the images. In addition, on the basis of the results obtained thereby, the image recognizing and processing means 70 can finally determine the number of the solid medications in step 13.

More specifically, when the counting of the solid medications is conducted by the image recognizing and processing means 70, images photographed by the imaging means 66 are firstly acquired in the image acquisition process of step 1. Then, the control flow shifts into the position correction process of step 2. In the position correction process, the deviations between the positions of the monitoring platform 62 contained in the images acquired in step 1 and the position (reference position) of the monitoring platform 62 prior to being vibrated are detected, and the position information of the acquired images is corrected on the basis of the detection results. As such, a counting error of solid medications caused by positional deviations can be prevented in the following processes.

When step 2 is completed, the process shifts into the concentration correction process of step 3. The concentration correction process is performed in consideration of the fact that as the brightness of the illumination 66*c* may be deteriorated or unstable due to the life or a minute change of an LED, the brightness of the images acquired by imaging may be possibly unstable. In the concentration correction process, the brightness of the same region in photographed images are compared and calculated with reference to the brightness at a predetermined time point, and correction is performed as desired.

Figure 9:
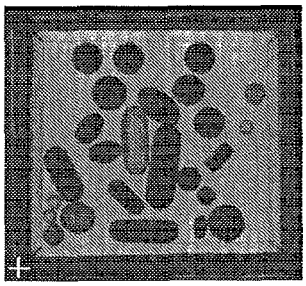
Figure 9:
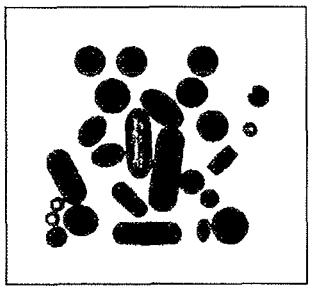
Figure 9:
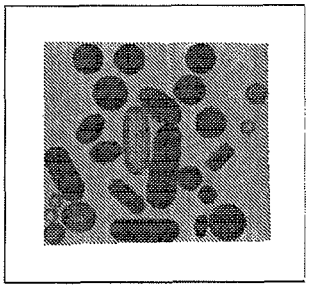
Figure 9:
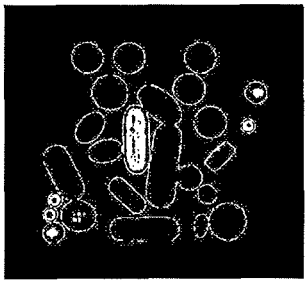
Figure 9:
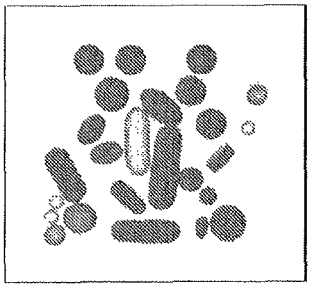
Figure 9:
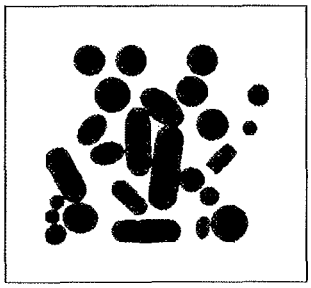

The images concentration-corrected in the step 3 (see FIG. 9*a*) are mask-processed in the mask-processing process of step 4. The mask-processing process is a process for deleting unnecessary regions from the concentration-corrected images using a mask image, in which the mask image is prepared by coloring an unnecessary part as black in an image previously obtained by imaging the monitoring platform 62. The mask-processing is conducted by overlapping the above-mentioned mask image on each of the concentration-corrected images acquired in step 3, and deleting the part overlapped with the black region of the mask image while not processing the part overlapped with a white region. An image (a mask-processed image) obtained in step 4 is as shown in FIG. 9*b*, and further processed in a background removal process of step 5. In the background removal process, an image (a background-removed image) as shown in FIG. 9*c* is obtained by extracting only an image of solid medications from the mask-processed image.

If background-removed images are obtained in step 5, the background-removed images are binarized in a binarization process of step 6. In the binarization process, a simple binary image as shown in FIG. 9*d* is obtained by simply binarizing a background-removed image using a predetermined concentration value (in the present embodiment, the concentration value=250) as a threshold. Both of the transparent solid medications reflected with a low concentration and the solid medications reflected with a high concentration in the background-removed image as shown in FIG. 9*c* are sometimes expressed as black in a simple binary image. Herein, the central part of a transparent solid medication is sometimes expressed as white in a simple binary image as shown in FIG. 9*d*, which may possibly cause a problem in the following processing.

Figure 10:
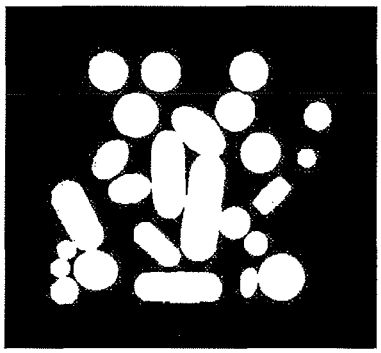
Figure 10:
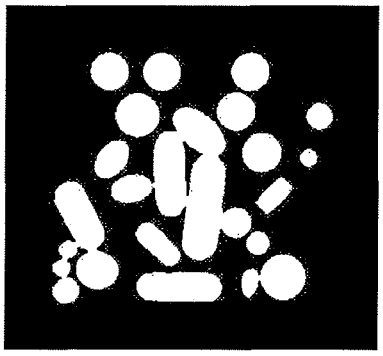
Figure 10:
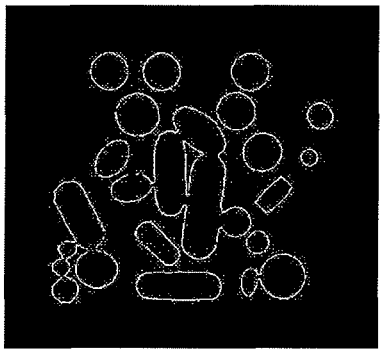

Therefore, in order to solve this problem, image processing is further performed in the binarization process so as to acquire an image (binary composite image) in which parts corresponding to solid medications are entirely expressed as black. Specifically, in addition to the above-mentioned simple binary image, a binary difference image (see FIG. 9*e*) is further acquired by binarizing the background-removed image using two concentration values (in the present embodiment, concentration values 150 and 250) as thresholds. Thereafter, a binary composite image (see FIG. 9*f*) is acquired by extracting the black region surrounded by white from the binary difference image, and composing the black region with the above-mentioned simple binary image. If a binary composite image is acquired thereby, the process proceeds to a reversing process of step 7. In the reversing process, the black and white colors in the binary composite image are reversed for labeling processing to be subsequently performed. As such, a reverse image as shown in FIG. 10*a* is acquired.

If the reverse image is acquired in step 7, the step proceeds to a contraction processing process of step 8. In step 8, a task for removing noise (foreign matter) contained in the image or separating one or more parts in which the solid medications are shown as being connected with each other is performed by cutting the parts expressed as white in the reverse image along the peripheries thereof. When step 8 is completed, a contraction image as shown in FIG. 10*b* is obtained, and the process proceeds to a labeling process of step 9. In the labeling process, individual features are extracted for each of the parts expressed as white in the contraction image. Specifically, features, such as positions, sizes, areas and centers of the white parts, are extracted.

If labeling is performed in step 9, the process proceeds to a contour extraction process of step 10. In the contour extraction process, contours forming peripheries of the solid medications and gaps among the solid medications are extracted on the basis of information obtained in step 9. Thereby, a contour image as shown in FIG. 10*c* is obtained. Then, the process proceeds to a count process shown in step 11.

In step 11, detection of a constricted part in which solid medications are overlapped and calculation of the number of the solid medications are performed on the basis of coordinate information obtained in the contour extraction process of step 9. Specifically, the number (X) of the solid medications is determined in accordance with Equation 1 as follows:

$$X=\{(\text{number of outer constricted parts})+(\text{number of inner constricted parts})\}/2-(\text{number of inner gaps}-1) \quad \text{(Equation 1)}$$

Figure 11:
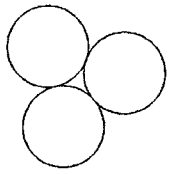
FIGS. 11*a* to 11*c* are illustrative views showing examples of contour images obtained when solid medications are counted by the medication counting means, respectively.
Figure 11:
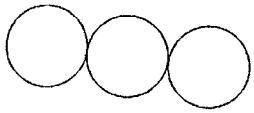
Figure 11:
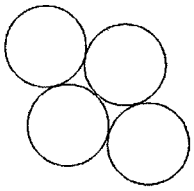

Specifically, for example, the number (X) in the case of FIG. 11*a* is determined as three (3) through the calculation based on Equation 2 below. In addition, the numbers (X) in the case of FIGS. 11*b* and 11*c* are determined as three and four in accordance with Equation 3 and Equation 4, respectively.

$$X=(3+3)/2-(1-1)=3[E/A] \quad \text{(Equation 2)}$$

$$X=(4+0)/2-(0-1)=3[E/A] \quad \text{(Equation 3)}$$

$$X=(4+6)/2-(2-1)=4[E/A] \quad \text{(Equation 4)}$$

The counting process of steps 1 to 11 is performed for all images (in the present embodiment, ten images) imaged while the monitoring platform 62 is being vibrated by the vibration means 64. If it is identified that a series of the above-mentioned processings are performed for all of the images in step 12, the process proceeds to step 13. In step 13, the largest number among the counted numbers obtained by repeating steps 1 to 11 plural times is determined as the number of the solid medications in step 13.

The medication dispensing device 10 of the present embodiment can monitor whether a correct quantity of solid medications are dispensed by comparing the quantity of solid medications of one package dose (hereinafter, the quantity is also referred to as a "count value") determined by counting of the medication counting means 60 with the quantity of solid medications of one package dose based on prescription data sent to the medication dispensing device 10 as prescription information (hereinafter, the quantity is also referred to as a "set value"). Specifically, for example, in step 13 or the like of the above-mentioned control flow, monitoring can be conducted in accordance with a method set forth below.

Assuming the number of images picked up by the camera 66*a* of the imaging means 66 is n, and the quantity of solid medications (set value) per each prescription based on prescription data is N, standards of judgment can be established as shown in Table 1.

TABLE 1

| | | Count Value | | |
|---|---|---|---|---|
| Number of Time of Counting | | 1<br>N + α | 2<br>N | 3<br>N − α |
| A | n | x | ○ | x |
| B | n − 1 | x | ○ | x |
| C | n − 2 | x | Δ | x |
| D | n/2 | x | x | x |

Specifically, assuming that the set value is N (for example, N>2), n images (for example, n>5) are photographed by the imaging means 66 while the monitoring platform 62 is being vibrated for counting the solid medications, and counting is conducted for each of the photographed images, it is possible to determine whether the count values obtained by counting are correct or not using each of the conditions (a) to (e) as standards of determination.

(a) When it is determined that the count value is larger than a set value (N+α(α<2)), and the number of times of determination is not less than n/2 times (refer to items A-1, B-1, C-1 and D-1 in Table 1), it is determined as being erroneous (indicated by mark "x" in Table 1).

(b) When it is determined that the count value is smaller than a set value (N−α(α<2)), and the number of times of determination is not less than n/2 times (refer to items A-3, B-3, C-3 and D-3), it is determined as being erroneous (indicated by mark "x" in Table 1).

(c) When it is determined that all the count values are equal to the set value (N) (refer to item A-2 in Table 1), it is determined as being normal (indicated by mark "o" in Table 1).

(d) When it is determined that the count value obtained by counting n−1 times, i.e. the count value obtained by all the countings except one counting is equal to the set value, N (refer to item B-2 in Table 1), it is determined as being normal (indicated by mark "o" in Table 1).

(e) When it is determined that the count value obtained by counting n−2 times, i.e. the count value obtained by all the countings except two countings is equal to the set value, N (refer to item C-3 in Table 1), it is determined as being pseudo-normal (indicated by mark "Δ" in Table 1).

In addition, it is possible to enhance monitoring precision by adding separate standards of determination, presuming different factors: for example, in the case (e) above, the two countings that obtained count values different from the set value, N, resulted from a count error influenced by dust, light or the like.

As a result of monitoring in accordance with the above-mentioned monitoring method, when it is determined that a prescription judged as being erroneous is included, it is possible to inform of the monitoring result in such a manner that an operator can easily understand the monitoring result, by forming an empty package following the final package among the packages dispensed by the number of packages needed for the corresponding prescription, and then adding a pack, on which an instruction to be reidentified is printed, to the empty package, or by displaying a symbol or instruction, etc for calling attention to a warning on a screen provided on the main body of the medication dispensing device 10 or at a side of a separately installed prescription monitor screen. In addition, when a prescription containing an indication for calling attention to the warning is displayed, it is possible to allow clicking or touching of the prescription on the screen, which enables a user to identify more specifically the position in an order of a package in which an error has occurred.

When the counting of the solid medications is completed by the medication counting means 60, the medication dispensing device 10 of the present embodiment operates the discharge means 68, so that solid medications laid on the monitoring platform 62 are dispensed to the bottom side of the section forming body 52 by the sliding movement body 68*c*. Thereafter, the solid medications are fed from the discharge port (not shown) to the medication wrapping means 80 through the discharge hopper 58.

As shown in FIGS. 2 and 6, the medication separate-wrapping device 80 is installed below the medication preparation means 50. The medication separate-wrapping device 80 may be removed as indicated by an arrow in FIG. 6 for maintenance and administration, in which the medication separate-wrapping device 80 is typically positioned directly under the medication preparation means 50. The medication separate-wrapping device 80 can dispense the solid medications supplied through the discharge hopper 58 one package dose at a time to the outside of the main body 20.

As described above, the medication dispensing device 10 of the present embodiment is configured to directly image solid medications discharged to the monitoring platform 62 from the storage section 55 of the medication preparation means 50 without an individual wrapping paper or the like. For this reason, in the medication dispensing device 10, there is not caused deterioration in counting precision that is caused when an individual wrapping paper or characters or the like printed on the individual wrapping paper is reflected in the image. In addition, in the medication dispensing device 10, the solid medications are pressed when they are discharged from the medication preparation means 50, and spread on the monitoring platform 62. In addition, in the medication dispensing device 10, the monitoring platform 62 is vibrated horizontally by the vibration means 64 when the medications are imaged, which causes individual solid medications to be widely spread on the monitoring platform 62. Therefore, there is a small possibility of imaging the medications in the overlapped or contacted state, which makes it possible to count the number of the solid medications correctly.

As described above, because the vibration means 64 reciprocates the monitoring platform 62 horizontally to afford vibration to the solid medications, it is easy for the solid medications to be smoothly spread on the monitoring platform 62 under the influence of differences in center of gravity between of the individual solid medications, inertia applied to the solid medications and the like. In addition, because there are provided grooves 62*b* on the monitoring platform 62 which are formed by linear protrusions 62*a* extending in the vibration direction, the solid medications are guided by the protrusions 62*a* to reciprocate on the monitoring platform 62, and are easily separated from each other by the protrusions 62*a* as boundaries. Therefore, with the above-mentioned construction, it is possible to restrain the occurrence of faulty counting due to the overlap of solid medications.

Although it was exemplified in the above-mentioned embodiment that the vibration means 64 vibrates in the direction toward and away from the section forming body 52, i.e. in the direction following the dispensing direction of solid medications dispensed from the storage section 55, and the grooves 62*b* are formed by the protrusions 62*a* extending in the corresponding direction, the present invention is not limited to this. Specifically, it is sufficient if the vibration means 64 vibrates horizontally. For example, the vibration means may reciprocate in a direction crossing the dispensing direction to make the solid medications vibrate. In addition, the protrusions 62*a* may extend likewise in relation to the dispensing direction. In addition, the protrusions 62*a* may be formed in proper shapes or forms. For example, it is possible to form each of the protrusions 62*a* by providing bumps arranged side by side in a row rather than extending in series. In addition, the protrusions 62*a* may be formed by providing the bumps in a dot shape or a net shape on the whole or a part of the monitoring platform 62.

As shown in the flowchart of FIG. 8, the medication dispensing device 10 is configured to image solid medications dispensed one package dose at a time to the monitoring platform 62 plural times by the imaging means 66, and to conduct image analysis for each of the plural images (ten images in the above-mentioned embodiment) obtained by imaging the solid medications to determine the quantity of the solid medications. The largest one among the quantities determined from the plural images is recognized as the quantity of the solid medications associated with the corresponding prescription. As a result, it is possible to more reliably prevent the occurrence of faulty counting caused by misrecognizing plural medications as a single mass.

Although it was exemplified in the above-mentioned embodiment that the solid medications dispensed to the monitoring platform 62 are imaged plural times under the circumstance of vibrating the monitoring platform 62, and image analysis is conducted for each of the plural images, the present invention is not limited to this. Specifically, it is possible to conduct imaging only once under the circumstance of vibrating the monitoring platform 62, and to analyze the image obtained thereby to determine the number of solid medications. In addition, it is also possible to determine the number of solid medications using only some of the images photographed under the circumference of vibrating the monitoring platform 62.

In the medication dispensing device 10, it is possible to sequentially rotate the disk-shaped section forming body 52 about the central axis 52*a* to move each of the storage sections 55 to a position adjacent to the monitoring platform 62, so that the solid medications received in each of the storage sections 55 can be discharged to the monitoring platform 62. Therefore, with the construction of the medication dispensing device 10, it is needless to install the monitoring platform 62 at each of the storage sections 55, which makes it possible to make the construction of the device compact. Although it was exemplified in the above-mentioned embodiment that the monitoring platform 62 is positioned adjacent to the outer periphery of the section forming body 52, the present invention is not limited to this. Specifically, for example, if the section forming body 52 is formed in a donut shape, it is possible to install the monitoring platform 62 at the central space, i.e. a position adjacent to the inner periphery of the section forming body 52, so that solid medications can be dispensed to the monitoring platform 62 from each of the storage sections 55. In addition, although it was exemplified in the above-mentioned embodiment that each of the storage sections 55 can be moved to the position adjacent to the monitoring platform 62 as the section forming body 52 is rotated, the present invention is not limited to this. For example, it is possible to configure the monitoring platform 62 to be relatively movable along the section forming body 52.

Although it was exemplified in the above-mentioned embodiment that a camera 66*a* forming the imaging means 66 is installed at a position adjacent to the monitoring platform 62, and the image of the monitoring platform 62 reflected in the mirror 66*b* is adapted to be capable of being photographed by the camera 66*a*, the present invention is not limited to this, and it is possible to make the camera 66*a* photograph the solid medications on the monitoring platform 62 without the mirror 66*b*. With this construction, although the height of the medication dispensing device 10 may be possibly increased, it is possible to simplify the construction of the device because the mirror 66*b* may not be installed.

Although a preferred embodiment of the present invention has been described for illustrative purposes, those skilled in the art will appreciate that various modifications, additions and substitutions are possible, without departing from the scope and spirit of the invention as disclosed in the accompanying claims.

The invention claimed is:

1. A medication dispensing device, comprising:

a medication supply unit configured to supply solid medications in accordance with a prescription;

at least one storage unit configured to store and discharge the solid medications supplied by the medication supply unit in a predetermined amount for packaging;

a medication monitoring mount on which the solid medications are placed;

an imaging unit fixed above the medication monitoring mount and configured to capture a plurality of images of the solid medications, discharged in accordance with a dose based on the prescription, on the medication monitoring mount;

a counting unit configured to count a quantity of the solid medications on the medication monitoring mount, by an image recognizing and processing means, based on each of the images captured by the imaging unit, and compare the counted quantity of the solid medications with a quantity of solid medications corresponding to the dose based on the prescription.

2. The medication dispensing device of claim 1, further comprising a vibrating unit coupled to the medication monitoring mount and configured to vibrate the medication monitoring mount in a predetermined direction while the plurality of images is being captured.

3. The medication dispensing device of claim 2, wherein the vibrating unit is configured to vibrate the medication monitoring mount by reciprocating the medication monitoring mount in the predetermined direction.

4. The medication dispensing device of claim 2, wherein the counting unit is configured to set a largest quantity among the counted quantities as the quantity of the solid medications with regard to the dose based on the prescription.

5. The medication dispensing device of claim 2, wherein the medication monitoring mount includes a plurality of grooves extending along the predetermined direction.

6. The medication dispensing device of claim 1, comprising a plurality of the storage units, wherein the storage units are aligned in a circular shape, constituting a partition-forming body, the medication monitoring mount is positioned adjacent to an outer or inner periphery of the partition-forming body, and the partition-forming body is configured to move each of the storage units to a position facing the medication monitoring mount, and each of the storage units is configured to discharge the solid medications toward the medication monitoring mount when moved to the position facing the medication monitoring mount.

7. The medication dispensing device of claim 1, wherein the imaging unit is a single camera fixed above the medication monitoring mount.

8. A medication dispensing device, comprising:

a medication supply unit configured to supply medications in accordance with a prescription;

a storage unit configured to store and discharge the medications supplied by the medication supply unit in a predetermined amount for packaging;

a medication monitoring mount on which the medications are placed;

an imaging unit configured to capture a plurality of images of the medications on the medication monitoring mount; and a counting unit configured to count a quantity of the medications based on each of the images captured by the imaging unit, and set a largest quantity among the counted quantities as the quantity of the medications with regard to the prescription.

9. A method of counting a quantity of medications, the method comprising:

discharging solid medications by a dose;

placing the discharged solid medications on a medication monitoring mount;

capturing a plurality of images of the solid medications on the medication monitoring mount;

counting a quantity of the solid medications on the medication monitoring mount based on each of the captured images to set a largest counted quantity among the counted quantities as the quantity of medications with regard to a prescription; and comparing each of the counted quantities with a quantity of medications determined based on prescription data of the prescription.

10. A method of counting a quantity of medications, the method comprising:

discharging medications by a dose in accordance with a prescription;

placing the discharged medications on a medication monitoring mount;

capturing a plurality of images of the medications on the medication monitoring mount;

counting a quantity of the medications on the medication monitoring mount based on each of the captured images; and setting a largest quantity among the counted quantities as the quantity of the medications with regard to the prescription.

* * * * *